US007518301B2

(12) United States Patent
Shimizu et al.

(10) Patent No.: US 7,518,301 B2
(45) Date of Patent: Apr. 14, 2009

(54) ELECTRON TUBES

(75) Inventors: Yukihiko Shimizu, Mobara (JP); Masao Saito, Mobara (JP); Kinya Ueda, Mobara (JP); Masahiro Nakayama, Mobara (JP); Kazushige Noguchi, Mobara (JP)

(73) Assignee: Futaba Corporation, Chiba-ken (JP)

( * ) Notice: Subject to any disclaimer, the term of this patent is extended or adjusted under 35 U.S.C. 154(b) by 742 days.

(21) Appl. No.: 11/035,545

(22) Filed: Jan. 14, 2005

(65) Prior Publication Data

US 2005/0156498 A1 Jul. 21, 2005

(30) Foreign Application Priority Data

Jan. 20, 2004 (JP) ..... 2004-011395

(51) Int. Cl.
*H01J 1/18* (2006.01)

(52) U.S. Cl. ..... 313/269; 313/279

(58) Field of Classification Search ..... 313/495–497, 313/269–279, 278, 422, 446
See application file for complete search history.

(56) References Cited

U.S. PATENT DOCUMENTS 5,192,892 A * 3/1993 Aono et al. ..... 313/269
5,300,857 A * 4/1994 Imai et al. ..... 313/292
5,625,254 A * 4/1997 Hamada ..... 313/493
2004/0150321 A1 * 8/2004 Yonezawa et al. ..... 313/495

FOREIGN PATENT DOCUMENTS

| | | |
|---|---|---|
| JP | 02-295036 | 12/1990 |
| JP | 03-184247 | 8/1991 |
| JP | 03-257743 | 11/1991 |
| JP | 06-208846 | 7/1994 |

* cited by examiner

*Primary Examiner*—Nimeshkumar Patel
*Assistant Examiner*—Christopher M Raabe
(74) *Attorney, Agent, or Firm*—Quarles & Brady LLP

(57) ABSTRACT

In an electron tube including vibration absorbers for linear members such as filaments, a vibration absorbing means that is made of a vibration absorber with a large vibration absorption effect, has a simple configuration, and is attachable easily to filaments is provided. The vibration absorbing means is formed of a holder 231, a vibration absorber 241, and a getter shielding member 251. These three members are attached to a shielding electrode S overlying the front substrate 111 to dispose the vibration absorber 241 between the holder 231 and getter shielding member 251. The vibration absorber 241 is mounted to slide or rotate between the holder 231 and the getter shielding member 251. The vibration absorber 241 has an aperture 2413 in which the filament is engaged. The bottom (apex) of the aperture 2413 is formed eccentrically. The vibration absorber 241 is in line contact with the shielding electrode S, as shown in FIG. 3(*c*).

13 Claims, 9 Drawing Sheets

ELECTRON TUBES

CROSS REFERENCES TO RELATED APPLICATIONS

This application claims the priority benefit of Japanese Patent Application No. 2004-011395 filed on Jan. 20, 2004.

STATEMENT REGARDING FEDERALLY SPONSORED RESEARCH

Not Applicable.

BACKGROUND OF THE INVENTION

1. Field of the Invention

The present invention relates to electron tubes, such as fluorescent luminous tubes for optical print heads, fluorescent display tubes, flat cathode-ray tubes, and vacuum tubes, each in which cathode filaments, linear grids, linear getters, and linear dampers or linear spacers for them are provided. Particularly, the present invention relates to vibration absorbing means that can dampen linear members such as cathode filaments.

2. Description of the Prior Art

FIG. 9 is a schematic view illustrating a fluorescent luminous tube for an optical print head, which is an example of electron tubes provided with conventional filament vibration absorbing means (for example, refer to Japanese Patent Laid-open Publication No. Tokkai-hei 03-257743).

FIG. 9(*a*) is a plan cross-sectional view illustrating a fluorescent luminous tube for an optical print head. FIG. 9(*b*) is a cross-sectional view illustrating a fluorescent luminous tube for an optical print head, taken along line X1-X1 shown in FIG. 9(*a*). FIGS. 9(*c*) and 9(*d*) are enlarged views, each illustrating a filament vibration absorbing means. FIG. 9(*c*) is a cross-sectional view illustrating a filament vibration absorbing means, taken along line X2-X2 in FIG. 9(*b*). FIG. 9(*d*) is a side view illustrating a filament vibration absorbing means, taken from the direction X3 in FIG. 9(*c*).

In the fluorescent luminous tube, the envelope is formed of a front substrate 111, a back surface 112, and side members (side plates) 121 to 124. A plurality of anode electrodes A, on which a fluorescent substance is coated, are formed in a staggered state on the front substrate 111. Anchors 131 and 132 sustaining a filament F are mounted on the substrate 111. A vibration absorber 14 for absorbing vibration of the filament F is disposed adjacent to the anchor 131. A stopper 15 is mounted to regulate the vibration absorber 14 moving in the longitudinal direction of the filament F.

The vibration absorber 14 is made of a metal strip. One end of the strip is bent to surround the filament F and is welded at the welding spot 141 and the other end thereof is bent and is in contact with the front substrate 111. Referring FIG. 9(*b*), when the filament F, for example, vibrates vertically, the vibration absorber 14 swings vertically to damp the vibration of the filament F.

When assembling a fluorescent luminous tube, the conventional vibration absorber has to be fabricated by bending the metal strip so as to surround the filament and then welding it. However, since the filament is very thin (for example, about 30 μm), it is difficult to bend and weld the metal strip and cinder dusts are sputtered out from the metal strip during welding. Moreover, an electron emissive material (such as carbonate), which is coated over the surface of a filament, may be damaged due to high welding temperatures during welding. Moreover, part of the electron emissive material may be peeled off as flakes. For that reason, it is required to remove those wastes.

The conventional vibration absorber, made of a metal, has a large thermal conductivity, so that the heat of the filament tends to be dissipated. This leads to largely cooling the end of a filament by the vibration absorber. Finally, this becomes an obstacle to miniaturization of electron tubes, such as fluorescent luminous displays.

SUMMARY OF THE INVENTION

The present invention is made to solve the above-mentioned problems.

An object of the present invention is to provide a vibration absorbing means for linear members such as filaments, which is formed of a small thermal conductivity material.

Moreover, another object of the present invention is to provide a vibration absorbing means that is easily attachable to linear members such as filaments, without welding vibration absorbers, and allows small-sizing the installation space for a vibration absorber.

In an aspect of the present invention, an electron tube comprises an envelope; a linear member placed in the inside of the envelope; a support member for supporting the linear member; a vibration absorber engaged to the linear member; and a position regulation member for regulating a moving range of the vibration absorber; the vibration absorber having an aperture in contact with the linear member at a position eccentric from the barycenter thereof.

In another aspect of the present invention, an electron tube comprises an envelope; a linear member placed in the inside of the envelope; a support member for supporting the linear member; a vibration absorber engaged to the linear member; and a position regulation member for regulating a moving range of the vibration absorber; the vibration absorber having an aperture in contact with the linear member at a position eccentric from the barycenter thereof; the vibration absorber being in line or point contact with a substrate of the envelope or a component in the envelope, the vibration absorber being roatatable to the line or point contact portion acting as a fulcrum.

In another aspect of the present invention, an electron tube comprises an envelope; a linear member placed in the inside of the envelope; a support member for supporting the linear member; a vibration absorber engaged to the linear member; and a position regulation member for regulating a moving range of the vibration absorber; the vibration absorber having an aperture in contact with the linear member at a position eccentric from the barycenter thereof, the vibration absorber being in line or point contact with an inner surface of the envelope or a component in the envelope.

In the electron tube according to one embodiment of the present invention, the aperture of the vibration absorber is tilted with respect to the substrate of the envelope.

In the electron tube according to one embodiment of the present invention, the position regulation member is disposed on either side of the vibration absorber in the longitudinal direction to the linear member.

In the electron tube according to one embodiment of the present invention, the position regulation member regulates a moving range of the vibration absorber in a direction intersecting the longitudinal direction of the linear member.

The vibration absorber of the present invention has a very simple structure, that is, a strip with an aperture. The vibration absorber is engaged to the linear member such as a filament by merely hooking the filament to the aperture thereof. For that reason, the vibration absorber can be fabricated inexpensively and can be loaded very easily to the filament. The vibration absorber with an aperture formed slantingly is not disengaged even when the electron tube is installed vertically.

According to the present invention, the vibration absorber in a strip shape extends in the direction intersecting the longitudinal direction of a linear member such as a filament. Therefore, the vibration absorber can increase its vibration absorption effect by increasing the area, volume, and weight, without changing the thickness of the vibration absorber. That is, according to the present invention, the space in the direction intersecting the longitudinal direction of a linear member, such as a filament, can be used effectively as an installation space for the vibration absorber. Therefore, a large vibration absorption effect can be obtained without increasing the spacing (thickness) in the longitudinal direction of a linear member, such as a filament.

According to the present invention, since the bottom (apex) of the aperture of a vibration absorber is eccentric from the barycenter of the vibration absorber, the vibration absorber is inevitably engaged slantingly to the linear member, such as a filament. Thus, the base of the aperture is line or point contacted to the substrate of the envelope, a component, such as a shield electrode on the substrate (or a component in the envelope), or the inner surface of the envelope. As a result, the vibration absorber, which always applies its weight on the linear member, such as a filament, can always absorb the vibration of the filament, thus improving the vibration absorption effect.

According to the present invention, a linear member, such as a filament is hooked to the aperture of the vibration absorber, without securely fixing to the linear member. Hence, the vibration absorber rotates or slides smoothly around the linear member. When the linear member vibrates, an excessive force, such as a twist, is not applied to the linear member. When the aperture of the vibration absorber is line or point contacted to the linear member, the vibration absorber is rotated or slid more smoothly. Moreover, since the vibration absorber is line or point contacted to the substrate, the friction resistance between the vibration absorber and the substrate becomes small when the vibration absorber travels (or slides) over the substrate due to vibration of the linear member, so that the vibration absorber moves smoothly.

According to the present invention, a ceramic vibration absorber has a heat absorption property smaller than a metal vibration absorber, even if it is mounted to the filament, so that the heat dissipation of the filament is small and the cooling of the end of the filament becomes small.

According to the present invention, the getter shielding member used as the position regulation member has the function of a stopper of the vibration absorber. Accordingly, the number of components can be reduced without mounting a dedicated stopper and the installation space for the dedicated stopper is omitted. Moreover, the vibration absorber and the holder of the present invention, which have the function of a getter shielding member, can improve the getter shielding effect. In the fluorescent luminous tube for an optical print head, when the cathode filament vibrates due to external vibration, the current flowing from the cathode filament to the anode electrode changes, so that the luminous amount of a fluorescent substance varies. As a result, the image to be formed is subjected to a large influence such as gradation variation. However, the vibration absorber according to the present invention attenuates the vibration of the cathode filament in a short time and is preferable as a vibration absorber for a fluorescent luminous tube, particularly, for an optical head.

BRIEF DESCRIPTION OF THE DRAWINGS

This and other objects, features, and advantages of the present invention will become more apparent upon reading of the following detailed description and drawings, in which.

DETAILED DESCRIPTION OF THE PREFERRED EMBODIMENTS

Embodiments of the present invention will be described below by referring to FIGS. 1 to 8. In the respective drawings, the same numerals are attached to the common elements.

Figure 1A:
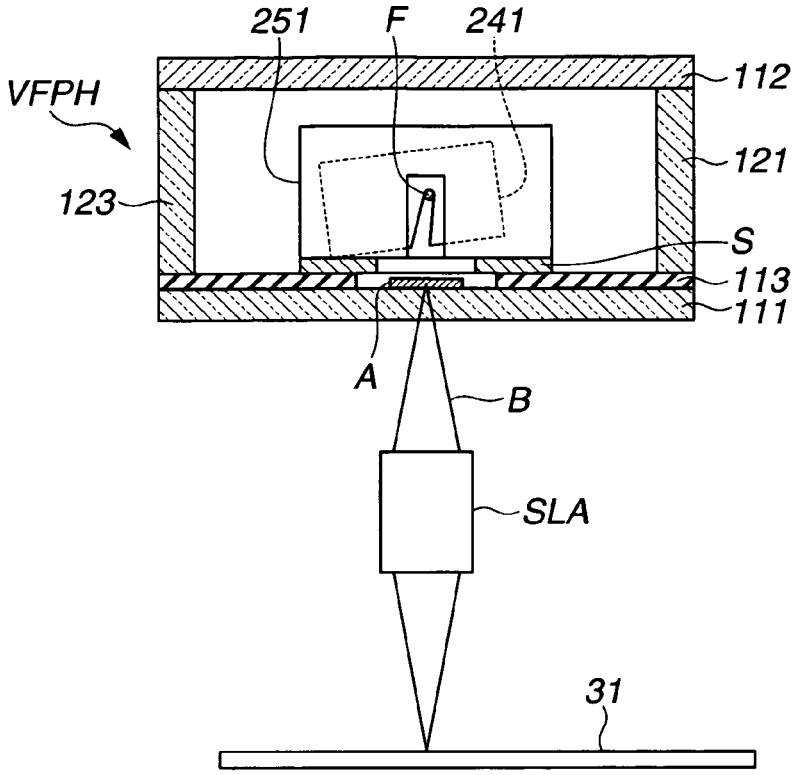
FIGS. 1(*a*) and 1(*b*) are schematic views, each illustrating a relationship between a fluorescent luminous tube and an optical system member for an optical print head, according to an embodiment of the present invention.
Figure 1B:
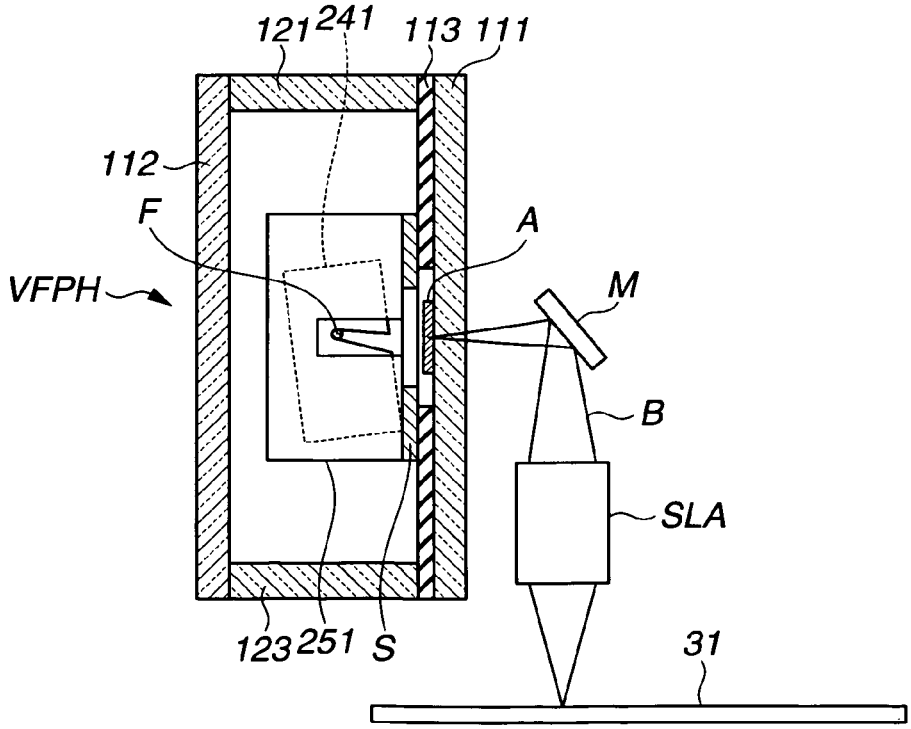

FIG. 1 is a schematic view illustrating an arrangement of a fluorescent luminous tube and an optical system member for an optical print head in an image forming device, according to an embodiment of the present invention. FIG. 1(*a*) shows an example of a fluorescent luminous tube disposed horizontally and FIG. 1(*b*) shows an example of a fluorescent luminous tube disposed vertically.

Referring to FIG. 1, a fluorescent luminous tube VFPH has an envelope, electrodes mounted inside the envelope, and others. In other words, the envelope includes a front substrate 111, a back substrate 112, and side members (side plates) 121, 123. An anode electrode A, on which a fluorescent substance is coated, an insulating layer 113, and a shielding electrode S are formed on the front substrate 111. A getter shielding member 251 is attached to the shielding electrode S. A vibration absorber 241 is engaged to the cathode filament F, which is a linear member.

A beam B of light emitted from the anode electrode A is radiated onto a photographic paper (for example, a silver salt photographic paper) 31 via a mirror M and an imaging element (such as SLA), such as an elected equi-magnification imaging element. Thus, the photographic paper 31 is exposed to the light.

Referring to FIG. 1(*a*), the light beam B radiated from the anode electrode A falls onto the photographic paper via only the imaging element SLA. In the case of FIG. 1(*b*), the mirror M deflects the optical path of the light beam B and thus illuminates the photographic paper 31 via the imaging element SLA. In either case, the length of the optical path between the anode electrode A and the imaging element SLA is equal to the optical path between the imaging element SLA and the photographic paper 31. By considering the dead space in the direction parallel to the surface of the photographic paper 31 and the dead space in the direction vertical to the surface thereof, the configuration shown in FIG. 1(*a*) or FIG. 1(*b*) is selected.

Figure 2A:
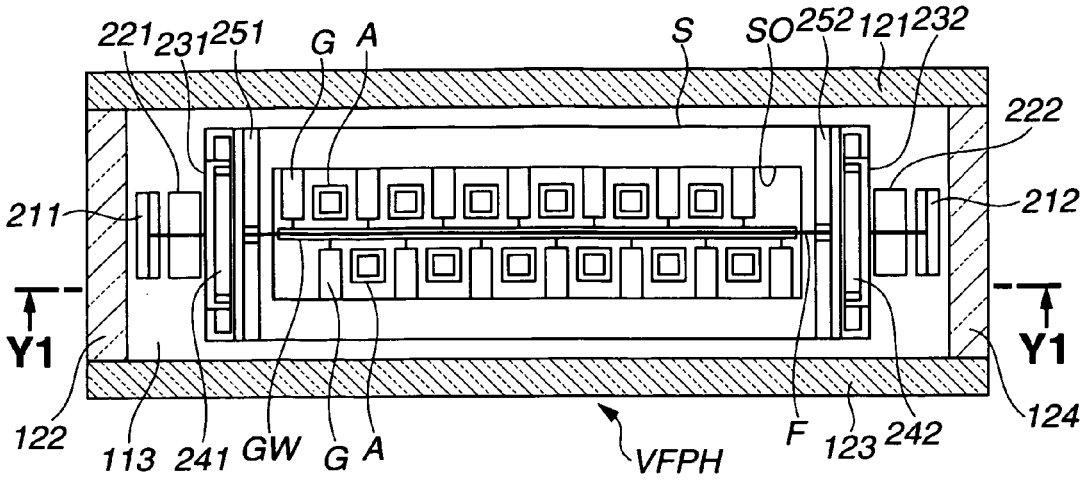
FIGS. 2(*a*), 2(*b*), and 2(*c*) are views, each illustrating the configuration of a fluorescent luminous tube for an optical head, according to an embodiment of the present invention.
Figure 2B:
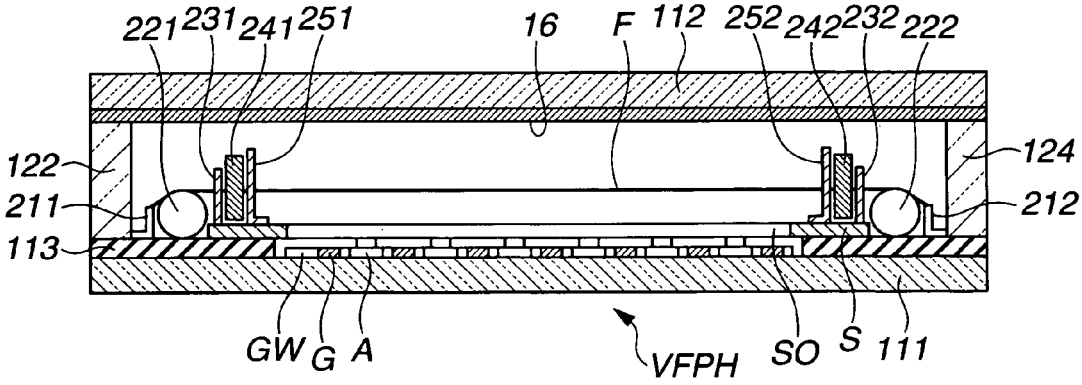
Figure 2C:
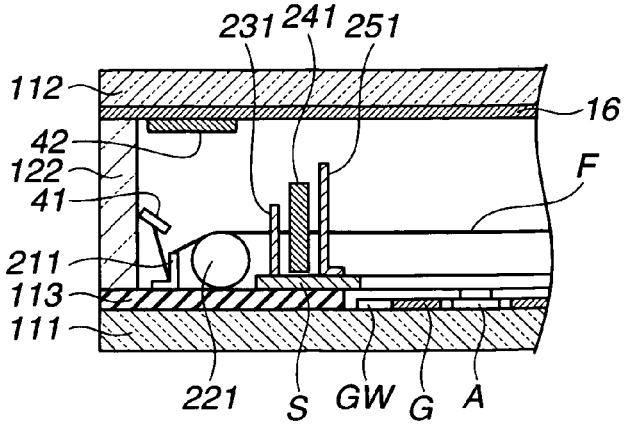
Figure 3A:
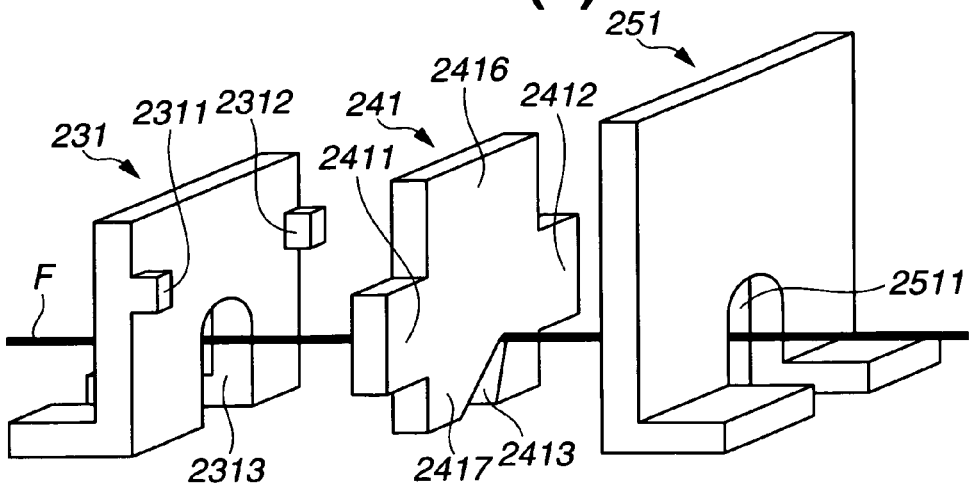
FIGS. 3(*a*), 3(*b*), 3(*c*) and 3(*d*) are views, each illustrating in detail a vibration absorber, an absorbing member holder, and a getter shielding member, shown in FIG. 2.
Figure 3B:
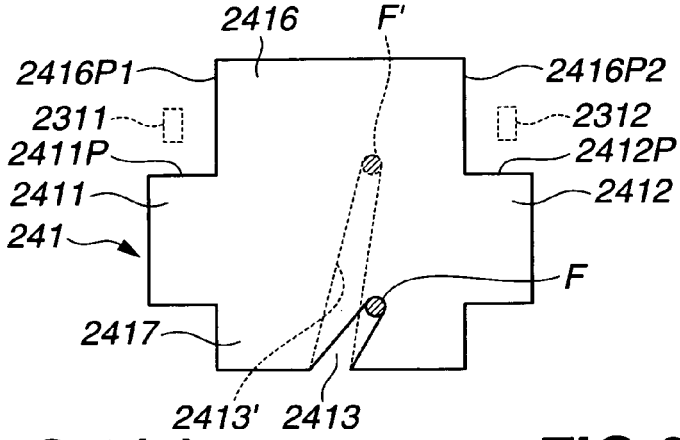
Figure 3C:
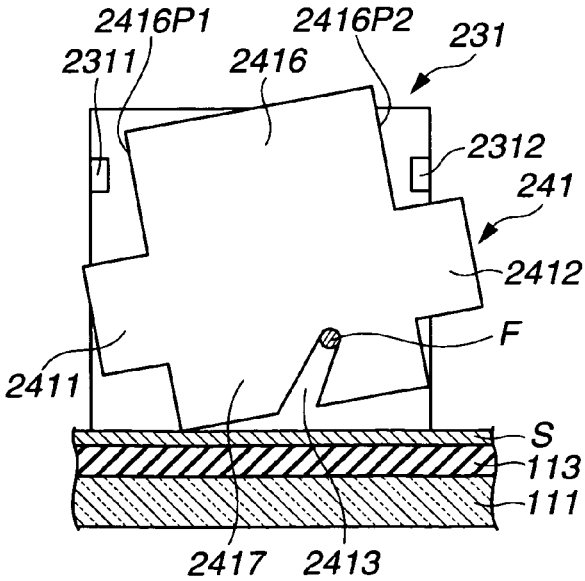
Figure 3D:
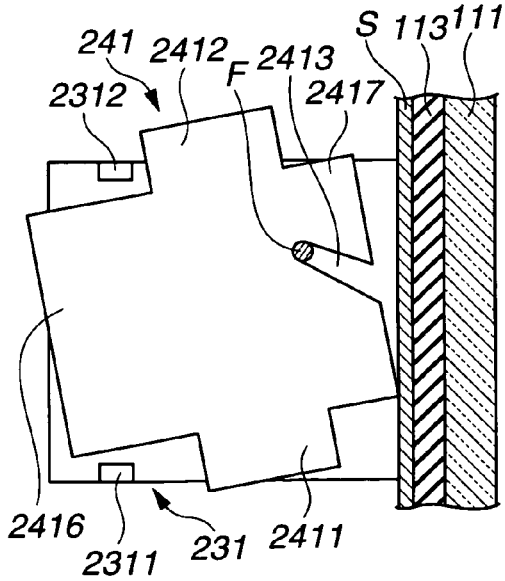
Figure 4A:
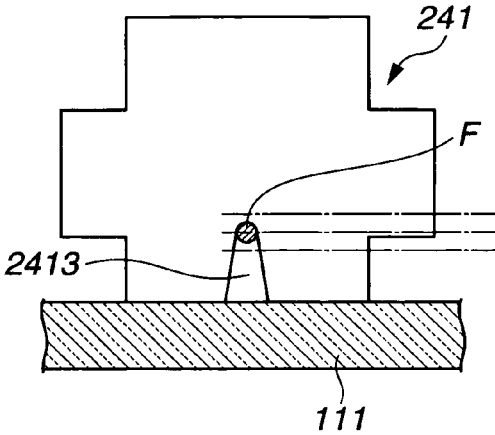
FIGS. 4(*a*), 4(*b*), 4(*c*) 4(*d*), and 4(*e*) are views, each illustrating in detail the function of the aperture of the vibration absorber shown in FIG. 3.
Figure 4B:
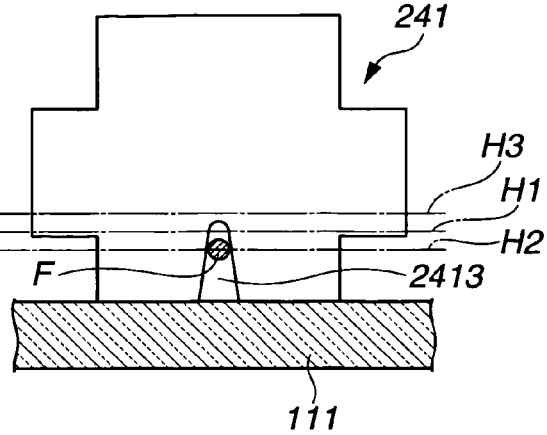
Figure 4C:
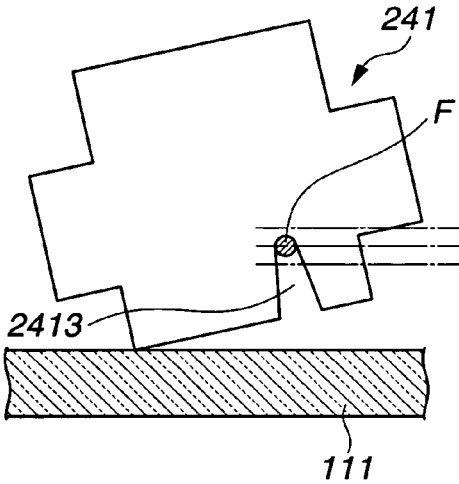
Figure 4D:
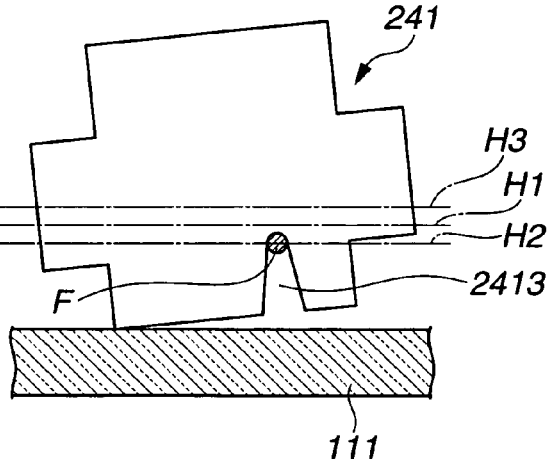
Figure 4E:
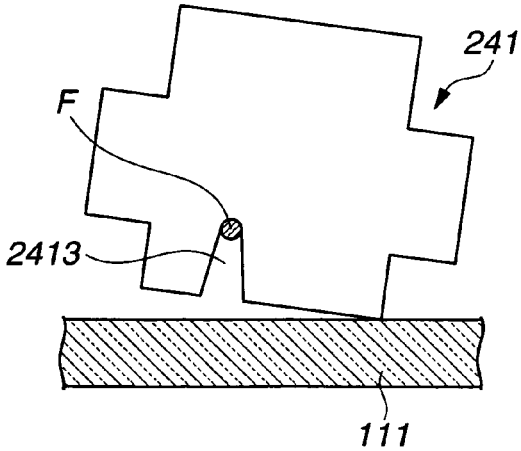

FIG. 2 is a view illustrating the configuration of a fluorescent luminous tube for a print head, being an example of electron tubes according to the embodiment of the present invention. FIG. 2(*a*) is a plan view illustrating a fluorescent luminous tube. FIG. 2(*b*) is a cross-sectional view illustrating a fluorescent luminous tube, taken along the arrows Y1 of FIG. 2(*a*). FIG. 2(*c*) is an enlarged view illustrating one end of the fluorescent luminous tube in FIG. 2(*b*).

Referring to FIG. 2, the envelope of the fluorescent luminous tube VFPH for an optical print head consists of a front substrate 111, a back substrate 112, and side members (side plates) 121 to 124. The front substrate 111 is made of an insulating material such as glass or ceramic. A plurality of anode electrodes A and a plurality of flat grids G are formed on the front substrate 111. The anode electrodes A are formed of a conductive material (such as Al), and a fluorescent substance, which light-emits due to impingement of the electrons emitted from a filament F, is coated on each anode electrode. The grids G are formed of a conductive material (such as Al) and control the electric field around each anode electrode. Respective anode electrodes are disposed in two rows and in a staggered state. The flat grids are connected to the common electrode (a common wiring conductor) GW, respectively.

A shielding electrode S is formed via the insulating layer 113 on the front substrate 111. The shielding electrode S reduces the reactive current flowing through the external lead wiring conductors for anode electrodes or for flat grids. The shielding electrode S has an aperture SO, which exposes the anode electrodes and the flat grids. Similarly, the insulating layer 113 has an aperture, which exposes the anode electrodes and the flat grids.

The filament F has both ends fixed respectively by the support members 211 and 212 and defines its level with columned spacers 221 and 222. The support members 211 and 212 may define the level without the columned spacers 221 and 222. The support member 211, 212 is made of a SUS304 alloy or a SUS36 alloy. The support members 211 and 212 may act as anchors (to support the filament F and to provide a tension to the filament F). Alternately, one support member may act as an anchor while the other support member may act as a support (only to support the filament F).

For the filament F, a member, on which an electron emissive substance (such as carbonate) is coated on the core of tungsten, is used. At least a portion of the core may be coiled and thus the coiled portion can provide a tension to the filament F. Accordingly, when a filament with coiled portions is used, both the support members 211 and 212 may be used as support members. In such a case, without using the support members 211 and 212, formed of the three-dimensionally machined metals, as shown in FIG. 2, metal films or metal plates are formed or attached to the substrate 111. Thus, by welding metal pieces to the metal plates, the end of the filament F may be fixed between them.

In the filament F, the electron emissive substance is removed at least between the support member 211 and the getter shielding member 251 and between the support member 212 and the getter shielding member 252. During the use of the fluorescent luminous tube, the vibration absorber 241, 242 (to be described later) prevents the electron emissive material from being peeled and sputtered. By removing the electron emissive material on the ends of the filament F, as described above, the heat dissipation of the electron emissive material removed portion becomes small, so that the cooling of the end of the filament becomes small.

A Nesa film 16, made of a transparent conductive film such as ITO and graphite layers laminated on the filament side, is formed on the back substrate 112. The Nesa film 16 prevents the electrostatic charge on the back substrate 112.

The spacing between the front substrate 111 and the back substrate 112 is about 4 mm and the spacing between the side member 121 and the side member 123 is about 10 mm. The elevation of the filament F (the diameter of the spacer 221, 222) is about 1.1 mm.

Adjacent to the ends of the filament F, the support member 231 of the vibration absorber 241 and the getter shielding member 251, as well as, the support member 232 of the vibration absorber 242 and the getter shielding member 252 are securely fixed on the shield electrode S. The vibration absorber 241 is held between the holder 231 and the getter shielding member 251 and the vibration absorber 242 is held between the holder 232 and the getter shielding member 252. The vibration absorbers 241 and 242 are engaged to the filament F. The holder 231 and the getter shielding member 251 act as stoppers to the vibration absorber 241 and the holder 232 and the getter shielding member 252 act as stoppers to the vibration absorber 242. This structure prevents the vibration absorber 241, 242 from moving horizontally (or in the longitudinal direction of the filament F).

FIG. 2(*c*) is an enlarged view illustrating the end of the structure in FIG. 2(*b*) (on the side of the vibration absorber 241). A getter 41 is attached to the support member 211. By evaporating the getter 41, a getter mirror (getter film) 42 of Ba is formed over the back substrate 112. While the fluorescent luminous tube is being used, gases such as CO inside the tube are adhered to create BaC. When BaC reacts with $H_2O$, BaO and hydrocarbon ($CH_4$, $CH_8$) are created. Because the getter mirror 42 does not nearly absorb $CH_4$, it emits $CH_4$ at a predetermined angle, so that $CH_4$ adheres to the fluorescent substance on the anode electrode A. The electrons from the filament decompose the adhered $CH_4$ into $H_2$ and C. $H_2$ is absorbed with the getter 42. However, C remains on the fluorescent substance, thus degrading (contaminates) the fluorescent substance. In order to prevent degradation of the fluorescent substance, the getter shielding member 251 blocks adhesion to the substance substrate on the anode electrode A of $CH_4$ emitted from the getter mirror 42. Moreover, the getter shielding member 251 prevents the vibration absorber 241 from moving in the longitudinal direction of the filament F and works as a stopper for the vibration absorber 241. Both the holder 231 and the vibration absorber 241 act as a getter shielding member. This is applicable to the holder 232, the vibration absorber 242, and the getter shielding 252.

The holders 231 and 232 and the getter shielding members 251 and 252, as shown in FIG. 2, are fixed to the shielding electrode S but may be mounted on the insulating layer 113 or the front substrate 111.

The anode electrodes A, the filaments F, and the common electrode GW for the flat grid G have wiring conductors (not shown in FIG. 2) to be connected to the power source and the driver circuit.

In FIG. 2, the vibration absorbers 241 and 242 are disposed on both ends of the filament F but may be disposed only on one end thereof. If there is a middle installation space, the vibration absorbers 241 and 242 may be disposed in the middle of the filament F, without being limited to both the ends of the filament F.

FIG. 3 is an enlarged view illustrating the holder 231, the vibration absorber 241, and the getter shielding member 251, shown in FIG. 2.

FIG. 3(*a*) is a perspective view illustrating the holder 231, the vibration absorber 241, and the getter shielding member 251.

The above three members are depicted separately but are disposed integrally on the front substrate 111 such that the vibration absorber 241 is sandwiched between the holder 231 and the shielding member 251, as shown in FIG. 2. The vibration absorber 241 can slide or rotate smoothly over the filament F and between the holder 231 and the getter shielding member 251. An aperture 2413 is formed in the vibration absorber 241, such that an immoderate force, such as a twist is not applied to the filament F when the filament F is in a vibrating state. Both the holder 231 and the getter shielding member 251 extend toward the back substrate 112 more than to the filament F. In other words, both the holder 231 and the getter shielding member 251 are formed at a level higher (larger) than the elevation of the filament F.

The vibration absorber 241 is formed of a main portion (a vertical portion) 2416, 2417 and wings 2411 and 2412. The main portion 2417 has the aperture 2413 through which the filament F passes. The bottom (apex) of the aperture 2413 is in contact with the filament F. The width of the aperture 2413 is larger than the diameter (thickness) of the filament F so that the vibration absorber 241 can rotate around the filament F. The width of the inlet of the aperture 2413 is larger than the width of the bottom thereof. Thus, the vibration absorber 241 can be easily engaged to the filament F.

The holder 231 has two nibs 2311 and 2312 and an aperture 2313 through which the filament F passes. The aperture 2313 has such a shape that the inner wall does not contact with the filament F when the filament F vibrates. The nib 2311 protrudes from above the wing 2411 of the vibration absorber 241 and the nib 2312 protrudes from above the wing 2412 of the vibration absorber 241. Thus, as described later, the filament F is prevented from disengaging the vibration absorber 241. The nib 2311, 2312 is in a non-bent state or in an open state (extends in the direction intersecting the longitudinal direction of the filament F) until the vibration absorber F is mounted. However, in installation, the vibration absorber 241 is bent as shown in FIG. 3(*a*). The nib 2311, 2312 may be formed in the getter shielding member 251, without being formed to the holder 231, or may be formed in both the holder 231 and the getter shielding member 251. Moreover, the nib 2311, 2312 may be formed in the getter shielding electrode S partially machined or in another component. Three or more nibs and three or more wings may be used.

The getter shielding member 251 has an aperture 2511 through which the filament F passes. The aperture 2511 has such a shape that the inner wall thereof does not contact with the filament F when the filament F vibrates.

By coupling together the portions to be mounted to the front substrate 111 for them, the holder 231 and the getter shielding member 251 may be integrally formed as a single nearly U-shaped component.

The holder 231 and the getter shielding member 251 are made of SUS304.

The vibration absorber 241 is made of a ceramic with a good slide property (for example, zirconia (ZrO2)) to avoid abrasion due to movement over the filament F. Ceramics such as alumina (Al2O3), silicon carbide (SiC), and carbon nitride (SiN), or sapphire may be used as the vibration absorber 241, without being limited to zirconia.

FIG. 3(*b*) shows positional relationships of the aperture 2413 of the vibration absorber 241.

The aperture 2413 of the vibration absorber 241 (the longitudinal direction when the aperture is a long opening (slit)) is slanted to the bottom of the main portion 2417, as shown in FIG. 3(*b*), or to the front substrate 111, as shown in FIG. 3(*c*). The bottom is shifted outward (or toward the side member side) from the center line on the plane perpendicularly to or intersecting the longitudinal direction of the filament F, thus being located at a position eccentric from the barycenter.

The aperture 2413, which is slanted as shown in FIG. 3(*b*), can prevent the vibration absorber 241 from being disengaged from the filament F even when the fluorescent luminous tube is installed vertically (to be described later). When the fluorescent luminous tube is installed horizontally, the aperture 2413 is not slanted. The bottom of the aperture 2413 may be formed deeper than the bottom of the aperture 2413 (or at a position farther from the substrate 111), as shown with the aperture 2413'. For example, when the filament is at the position F' (or at a position deeper than the position F), the aperture 2413' may be formed.

In the vibration absorber 241 disposed between the support member 231 and the getter shielding member 251, the nib 2311 of the support member 231 protrudes from above the wing 2411 of the main portion 2416 of the getter shielding member 251. The nib 2311 of the support member 231 protrudes from above the wing 2412 of the main portion 2416 of the getter shielding member 251. Even when the filament F vibrates and moves largely and horizontally (in FIG. 3(*b*)), the end surface 2416P1 of the main portion 2416 abuts the nib 2311 while the end surface 2416P2 thereof abuts the nib 2312. Accordingly, the vibration absorber 241 is not disengaged from the filament F. Moreover, even when the filament F vibrates and moves largely and vertically, the end surface 2411P of the wing 2411 abuts the nib 2311 while the end surface 2412P thereof abuts the nib 2312. For that reason, the vibration absorber 241 is not disengaged from the filament F.

Because the holder 231 and the getter shielding member 251 are elevated at the level higher (larger) than the elevation of the filament F, the vibration absorber 241 does not jump over the getter shielding member 251 to the anode electrode side even when the filament F vibrates largely.

The nib 2311, 2312 of the holder 231 has the function of the position regulation member in the direction intersecting the longitudinal direction of the filament F to the vibration absorber 241. The holder 231 and the getter shielding member 251 have the function of the position regulation member in the longitudinal member of the filament F.

When the width (length) or area of the vibration absorber 241 in the direction intersecting the longitudinal direction of the filament F is slightly smaller than the width (length) or cross sectional area in the direction of the inside of the envelope of the fluorescent luminous tube, the side members of the fluorescent luminous tube or the front substrate and the back substrate act as the nib 2311, 2312. By doing so, the nibs 2311 and 2312 can be omitted. In this case, since the vibration absorber 241 is engaged slantingly to the filament F (as described later), the edge line or corner of the main portion 2416, 2417 or the wings 2411, 2412 line-contacts or point-contacts with the inner surface of the envelope.

FIGS. 3(*c*) and 3(*d*) show the positional relationship between the installation direction of a fluorescent luminous tube and the aperture 2413 of the vibration absorber 241.

FIG. 3(*c*) shows a fluorescent luminous tube installed horizontally. When the vibration absorber 241 in an eccentric state is engaged to the filament F, it tilts in the left direction (counterclockwise). Thus, one edge line or one corner of the main portion 2417 is in line contact or point contact with the shielding electrode S on the front substrate 111. Therefore, when the filament F vibrates horizontally (in FIG. 3(*c*)), a force rotating around the contact portion acting as a fulcrum is applied to the vibration absorber 241. Thus, the weight of the vibration absorber 241 is applied to the filament F.

Referring to FIG. 3(*c*), the vibration absorber 241 is in contact with the shielding electrode S. However, when the filament F is elevated largely or the main portion 2417 is short, the vibration absorber 241 does not often contact to the shielding electrode S (this is applicable in the case of FIG. 3(*d*)). In this case, the end surface 2416P1 of the main portion 2416 is in line or point contact with the nib 2311. Therefore, when the filament F vibrates vertically (in FIG. 3(*c*)), the vibration absorber 241 moves vertically, with the changing contact portion, while the end surface 2416P1 is in line or point contact with the nib 2311. The weight of the vibration absorber 241 is applied to the filament F.

In the fluorescent luminous tube vertically disposed, as shown in FIG. 3(*d*), the vibration absorber 241 tilts in the left direction (counterclockwise) with respect to the vertical front substrate 111. One edge line or one corner of the vibration absorber 241 is in line or point contact with to the shielding electrode S of the front substrate 111. In this case, because the aperture 2413 is directed downward, the vibration absorber 241 is not disengaged from the filament F even when the filament F vibrates vertically and horizontally.

FIG. 3 has been used to explain the holder 231, the vibration absorber 241, and the getter shielding member 251. This explanation is applicable to the holder 232, the vibration absorber 242, and the getter shielding member 252.

As described above, the vibration absorber 241 has a simple configuration, that is, a ceramic strip having an aperture 2413. The filament F can be engaged to the aperture 2413 by merely hooking it to the aperture 2413. Therefore, since the vibration absorber 241 can be fabricated inexpensively and simply engaged to the filament F, the attachment work of the vibration absorber can be facilitated. Moreover, even when the aperture 2413 tilts and the fluorescent luminous tube is installed vertically, the vibration absorber 241 is not disengaged from the filament F. Referring to FIGS. 3(*c*) and 3(*d*), the vibration absorber 241 is in contact with the shielding electrode S (a component inside the envelope) on the front substrate 111. However, in the case of the fluorescent luminous tube with no shielding electrode S, the vibration absorber 241 may be in contact with the insulating layer 113 (a component inside the envelope) or with the front substrate 111 (a portion of the envelope).

Since the vibration absorber 241 in a strip form extends toward the direction intersecting the longitudinal direction of the filament F, the vibration absorption effect can be improved by increasing its area, volume and weight, without changing its thickness. In other words, the weight of the vibration absorber 241 can be adjusted by changing the size (area or volume) of the vibration absorber 241, without changing the spacing between the holder 231 and the getter shielding member 251. According to the present embodiment, the spacing between the holder 231 and the getter shielding member 251 can be effectively used as the installation space for the vibration absorber 241. The strip means that the width of the vibration absorber 241 in the direction intersecting the longitudinal direction of the filament F is larger (wider) than the width (thickness) of the vibration absorber 241 in the longitudinal direction of the filament F.

The vibration absorber 241 is made of a ceramic. Hence, even when the ceramic vibration absorber 241 is engaged to the filament F, the heat absorption thereof is smaller than that of the metal vibration absorber, so that the heat dissipation of the filament can be reduced. There is no the possibility that the ceramic vibration absorber 241 makes an electrical short circuit if it is contacted with electrodes other than the filament. Accordingly, the advantage is that the installation design of the vibration absorber 241 is not constrained.

FIG. 4 is a view explaining the function of the case where the bottom of the aperture in a vibration absorber is eccentric. In FIG. 4, the shielding electrode S and the insulating layer 113 on the front substrate 111 are omitted. First, explanation will be made below as to the vibration absorber, by referring to FIGS. 4(*a*) and 4(*b*).

FIGS. 4(*a*) and 4(*b*) show the case where the aperture of the aperture 2413 is not eccentric. FIG. 4(*a*) shows the case where the filament F is stationary. FIG. 4(*b*) shows the filament F simultaneously shifted toward the side of the front substrate 111 due to vibration.

In the stationary mode, the filament F is in contact with the bottom (apex) of the aperture 2413 of the vibration absorber 241 while one side of the vibration absorber 241 is in area contact with the front substrate 111. In such a state, when the filament F swings in the state shown in FIG. 3(*b*), the elevation of the filament F changes from H1 to H2. Meanwhile, since the filament F merely travels within the aperture 2413, the weight of the vibration absorber 241 is not applied to the filament F. For that reason, the vibration absorber 241 does not absorb the vibration of the filament F. Next, when the filament F swings back to the higher position H3 through the state of FIG. 4(*a*), the filament F lifts up the vibration absorber 241. As a result, the weight of the vibration absorber 241 is applied to the filament F, so that the vibration of the filament F is absorbed with the vibration absorber 241.

Accordingly, when the bottom of the aperture 2413 is not in an eccentric state, the vibration absorption effect of the vibration absorber 241 reduces by half.

FIGS. 4(*c*) and 4(*d*) show the case where the bottom of the aperture 2413 is eccentric. FIG. 4(*c*) shows the case where the filament F is stationary. FIG. 4(*d*) shows the filament simultaneously shifted toward the front substrate 111 by vibration.

In the case of FIG. 4(*c*), since the bottom of the aperture 2413 is tilted toward the right side, the vibration absorber 241 is tilted to the left side (counterclockwise), thus being in line contact with the front substrate 111. A force rotating clockwise with the line contact portion acting as the fulcrum is applied to the vibration absorber 241. As a result, the weight of the vibration absorber 241 is applied to the filament F so that the vibration of the vibration absorber F is absorbed with the vibration absorber 241. When the filament F in the state of FIG. 4(*c*) swings to the state of FIG. 4(*d*), the elevation of the filament F changes H1 to H2. However, since the vibration absorber 241 rotates clockwise during the swinging, the weight of the vibration absorber 241 is applied to the vibration absorber 241. Next, when the filament F swings back to the level H3 higher than that in FIG. 4(*c*) through the state of FIG. 4(*c*), the weight of the vibration absorber 241 is applied to the filament F. Therefore, when the bottom of the aperture 2413 is eccentric, the vibration absorber 241 settles the filament F during vibration.

Since the weight of the vibration absorber 241 is applied to the filament F, the vibration absorber 241 moves (vibrates) horizontally and vertically together with the filament F during the vibration of the filament F. The vibration energy of the filament F resulting from the movement is converted into the kinetic energy of the vibration absorber 241 and is absorbed by the vibration absorber 241. To move the vibration absorber 241, the heavier the vibration absorber 241 is, the larger the kinetic energy is. Therefore, the heavier the vibration absorber 241 is, the larger the vibration absorption effect is. Since the vibration absorber 241 is in contact with the front substrate 111, the vibration energy of the filament F is transmitted to the front substrate 111 via the vibration absorber 241, thus being attenuated. Moreover, when the filament F vibrates and the vibration absorber 241 contacts with the nib of the holder, the vibration energy of the filament F is transmitted to the holder through the vibration absorber 241 and the nib, thus being attenuated.

FIG. 4(*e*) shows an example of the bottom of the aperture 2413 in the vibration absorber 241, off-centered on the opposite side to those in FIGS. 4(*c*) and 4(*d*). In this case, the vibration absorption effect of the vibration absorber 241 is identical to those shown in FIGS. 4(*c*) and 4(*d*).

In the vibration absorber 241 described above, when the bottom of the aperture 2413 is merely off-centered, the weight of the vibration absorber 241 can always be applied to the filament F, so that the vibration absorption effect can be improved.

The vibration absorbers 241 and 242, shown in FIG. 2, may be tilted in the same direction or in different directions, respectively. For example, the vibration absorber 241 shown in FIG. 2 may be tilted to the right side, as shown in FIG. 4(*e*) and the vibration absorber 242 may be tilted to the left side, as shown in FIG. 3(*c*). In this case, since the twist direction of the filament F by the vibration absorber 241 is reversed to the twist direction of the filament F by the vibration absorber 242, the twist of the filament F can be decreased.

Figure 5A:
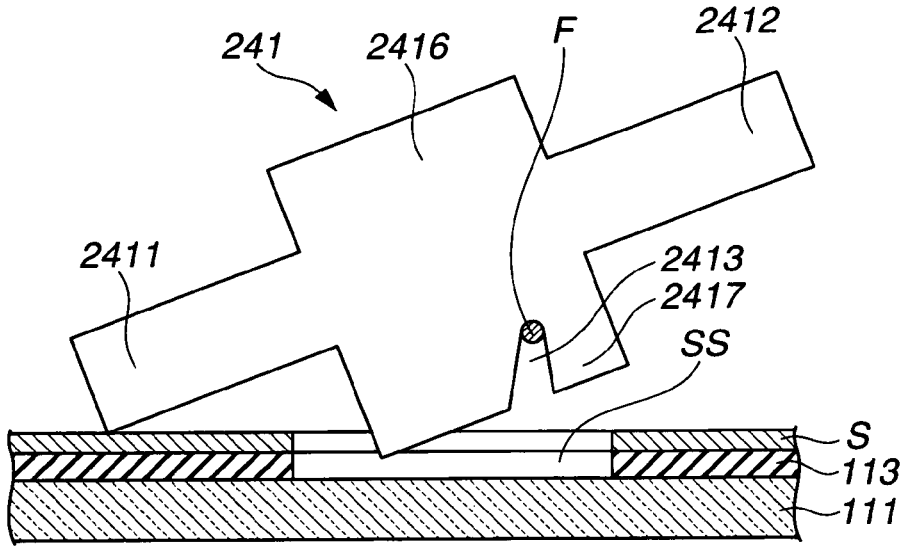
FIGS. 5(*a*) and 5(*b*) are views, each illustrating a modification of the vibration absorber shown in FIG. 3.
Figure 5B:
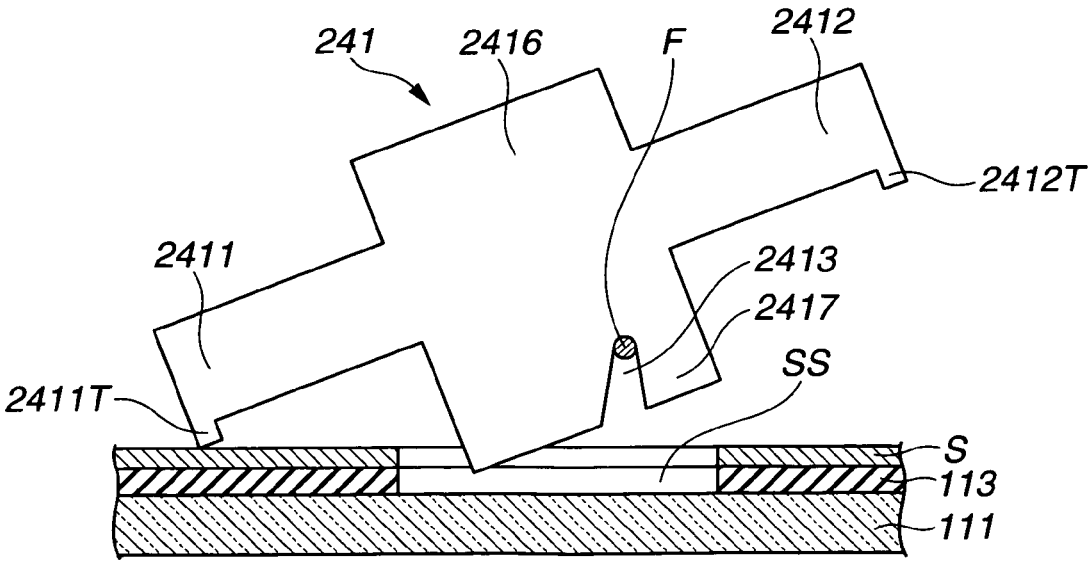

FIG. 5 is a view illustrating a modification of the vibration absorber in FIG. 3.

Referring to FIG. 5, a slit SS is opened in portions of the shielding electrode S and the insulating layer 113, each confronting the vibration absorber 241. A portion of the main portion 241 of the vibration absorber 241 is inserted into the slit SS. The wings 2411 and 2412 of the vibration absorber 241 extend long (widely) out from both the ends of the main portion 2416, 2417. Referring to FIG. 5, since the main portion 2417 of the vibration absorber 241 can be extended (or elevated) toward the front substrate 111, the aperture 2413 of the vibration absorber 241 can be formed deeply (or long). Accordingly, the vibration absorber 241 once engaged to the filament F becomes hard to be disengaged.

In the vibration absorber 241 shown in FIG. 5(*a*), one edge line or one corner of the wing 2411 is line or point contacted to the shielding electrode S and rotates around the contact point acting as the fulcrum. In the vibration absorber 241 of FIG. 5(*a*), since the long wing 2411, 2412 increases the distance between the fulcrum and the filament F, the weight of the vibration absorber 241 is effectively applied to the filament F. This can increase the vibration attenuation effect of the filament F.

In the vibration absorber 241 of FIG. 5(*b*), one end line or one corner of the protrusion 2411T of the wing 2411 is line or point contacted to the shielding electrode S and rotates around the contact point acting as the fulcrum. In a manner similar to that in FIG. 5(*a*), the long distance between the fulcrum and the filament F allows the vibration absorber 241 of FIG. 5(*b*) to rotate smoothly with the protrusion 2411T acting as the fulcrum. Therefore, the weight of the vibration absorber 241 is effectively applied to the filament F, so that the vibration absorption effect is improved. Moreover, since the vibration absorber 241 of FIG. 5(*b*) has the protrusion 2411T, the main portion 2417 can be extended toward the front substrate 111 by the degree of the protrusion 2411T. This configuration allows the aperture 2413 to be deepened and the weight of the vibration absorber 241 to be increased.

Figure 6A:
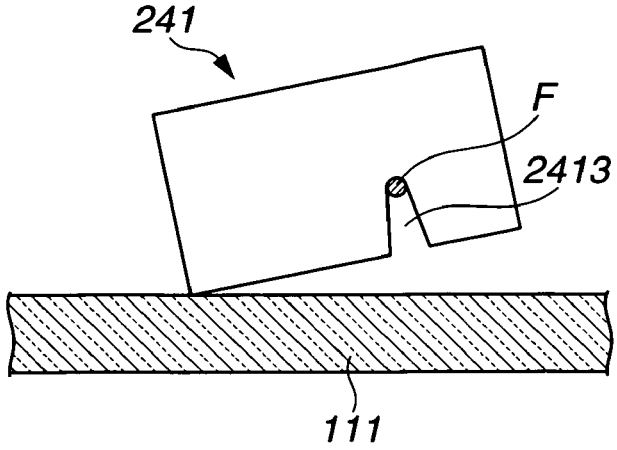
FIGS. 6(*a*), 6(*b*) and 6(*c*) are views, each illustrating a vibration absorber different in shape from the vibration absorber in FIG. 3.
Figure 6B:
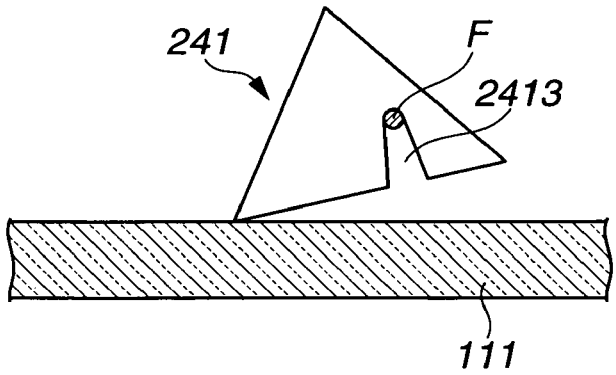
Figure 6C:
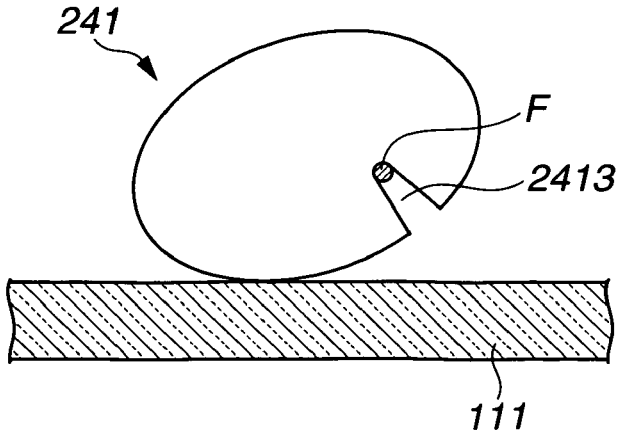
Figure 7A:
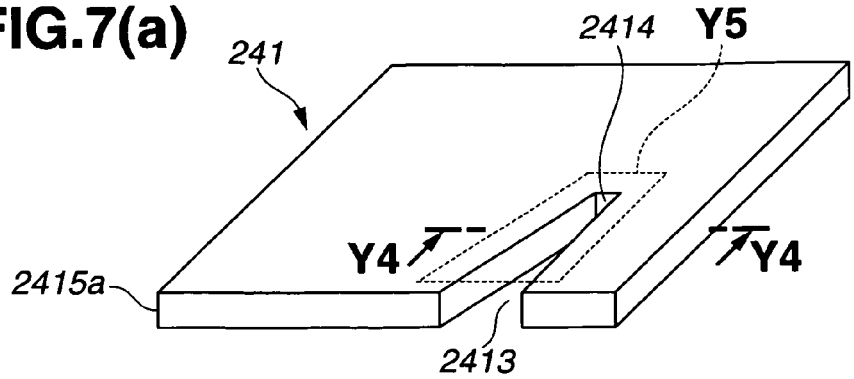
FIGS. 7(*a*), 7(*b*), 7(*c*), 7(*d*), 7(*e*), 7(*f*), 7(*g*), 7(*h*), 7(*i*), and 7(*j*) are schematic views, each illustrating the apertures and contact portions of the vibration absorbers in FIGS. 3, 5 and 6.
Figure 7B:
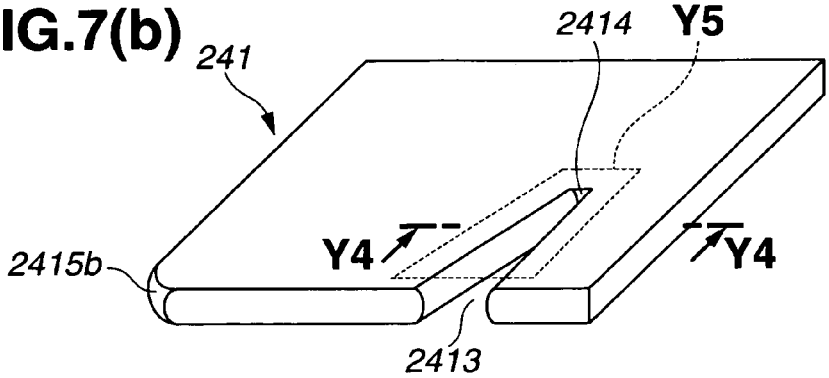
Figure 7C:
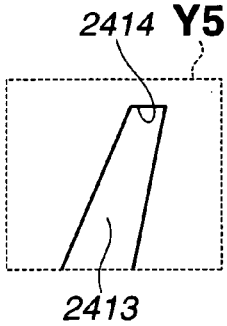
Figure 7D:
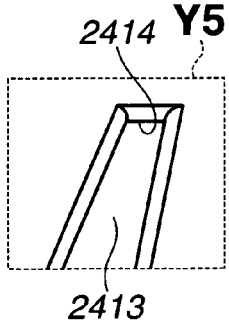
Figure 7E:
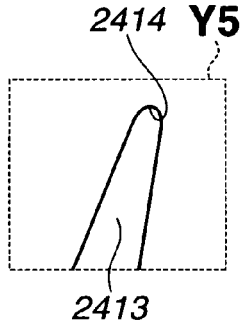
Figure 7F:
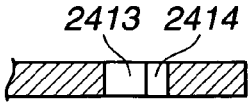
Figure 7G:
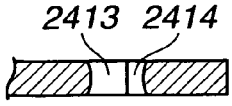
Figure 7H:
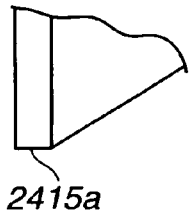
Figure 7I:
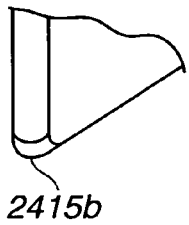
Figure 7J:
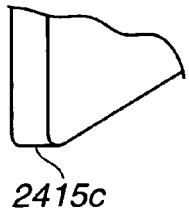

FIG. 6 is a view illustrating a vibration absorber different from in shape from the vibration absorber in FIG. 3. FIG. 6(*a*) shows an example of a rectangular vibration absorber. FIG. 6(*b*) shows an example of a triangular vibration absorber. FIG. 6(*c*) shows an example of an oval vibration absorber.

The shape of the vibration absorber 241 is arbitrary, without being limited only to the above examples.

FIG. 7 is a view illustrating different structures of the aperture of a vibration absorber and the contact portion.

FIGS. 7(*a*) and 7(*b*) are perspective views, each illustrating the vibration absorber 241. FIGS. 7(*c*) and 7(*d*) are plan views, each illustrating the vibration absorber 241 taken along line Y5 in FIGS. 7(*a*) and 7(*b*). FIGS. 7(*e*) and 7(*g*) are cross-sectional views, each illustrating the vibration absorber 241 taken along line Y4-Y4 and viewed from the arrows in FIGS. 7(*a*) and 7(*b*). FIG. 7(*h*) is a perspective view illustrating the portion adjacent to the corner 2415*a* of FIG. 7(*a*). FIG. 7(*i*) is a perspective view illustrating the portion adjacent to the corner 2415*b* of FIG. 7(*b*).

Referring to FIG. 7(*a*), the sides confronting the aperture 2413 and the bottom 2414 are flattened. The filament (not shown) passing through the aperture 2413 is line contacted to those surfaces. Referring to FIG. 7(*b*), the sides confronting the aperture 2413 and the bottom 2414 are made in a convex surface. The filament (not shown) passing through the aperture 2413 is point contacted to those surfaces.

The bottom 2414 of the aperture 2413 in FIGS. 7(*a*) and 7(*b*) are formed in a rectangular shape (or in a U-shaped form). However, the aperture 2413 may be formed in a curved state so as to surround the filament (not shown) passing through the aperture 2413 as shown in FIG. 7(*e*).

In the vibration absorber 241 of FIGS. 7(*a*) and 7(*b*), the corner 2415*a*, 2415*b* makes contact with the front substrate (not shown). However, the corner 2415*a* line-contacts to the front substrate and the corner 2415*a* point-contacts to the front substrate. When the corner 2415*a* in FIG. 7(*a*) is made in a curved state (in a round state), not in a rectangular state, the peripheral surface of the corner 2415*c* is line contacted to the substrate. When the vibration absorber 241 rotates, the point of the line contact changes along the peripheral surface.

Figure 8A:
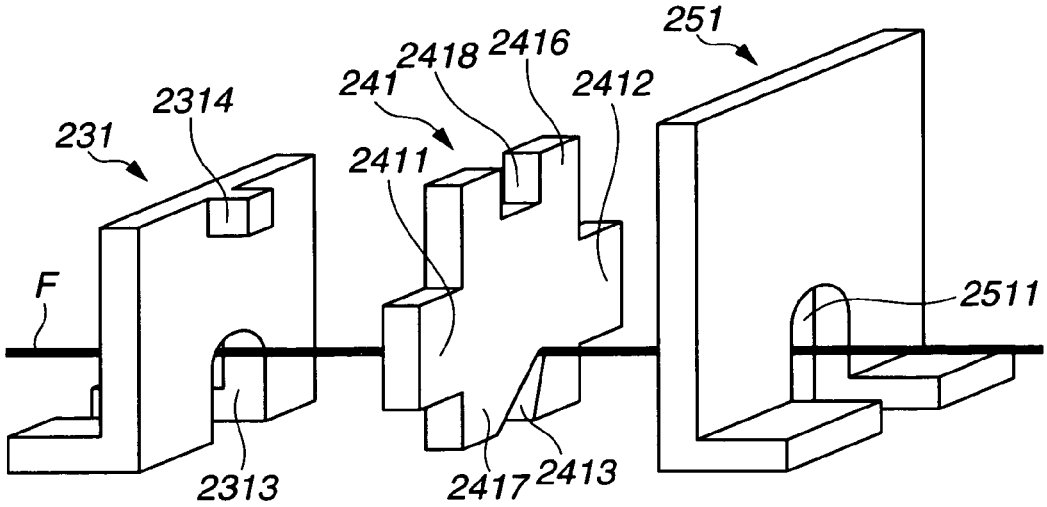
FIGS. 8(*a*), 8(*b*) and 8(*c*) are views, each illustrating a modification of the holder for the vibration absorber in FIG. 3.
Figure 8B:
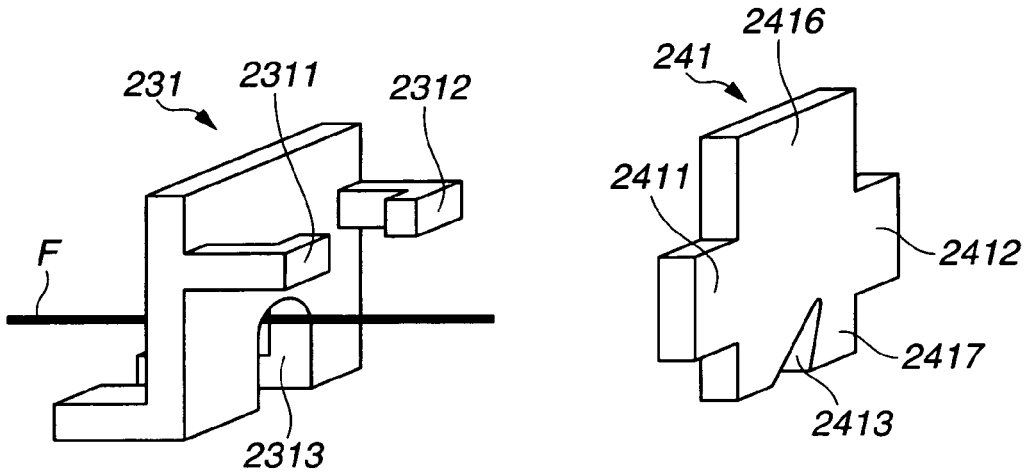

FIG. 8 is a view illustrating a modification of the holder of the vibration absorber in FIG. 3.

FIG. 8(*a*) shows a holder having one nib. FIGS. 8(*b*) and 8(*c*) show a holder having a nib with an L-shaped end.

In an example shown in FIG. 8(*a*), the nib 2314 is formed on the upper portion of the holder 231. The aperture 2418 corresponding to the nib 2314 is formed on the vibration absorber 241. The nib 2314 protrudes into the aperture 2418. The width and depth of the nib 2314 and the aperture 2418 (in FIG. 8(*a*)) regulate the vertical and horizontal moving ranges of the vibration absorber 241. The nib 2314 is formed in an open state. After the vibration absorber 241 is engaged to the filament F, it is bent as shown in FIG. 8(*a*).

Referring to FIG. 8(*a*), the use of one nib simplifies the configuration of the holder 231, so that the assembly work of the vibration absorber 241 facilitates.

Figure 8C:
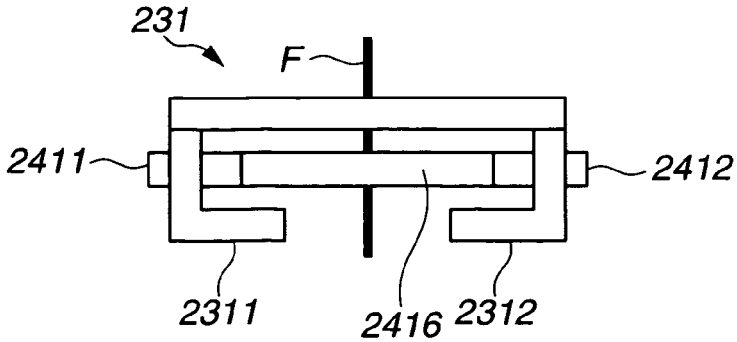
Figure 9A:
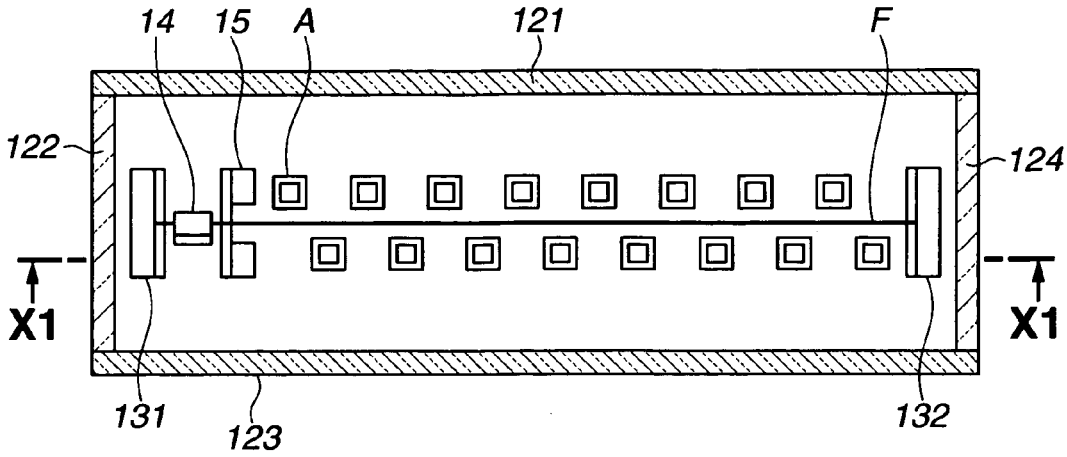
FIGS. 9(*a*), 9(*b*), 9(*c*), and 9(*d*) are views, each illustrating a conventional fluorescent luminous tube for an optical print head.
Figure 9B:
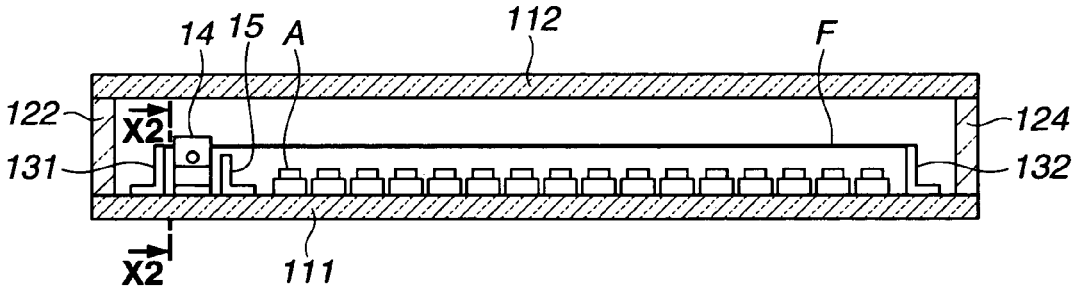
Figure 9C:
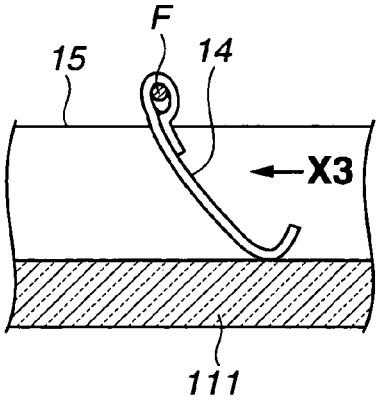
Figure 9D:
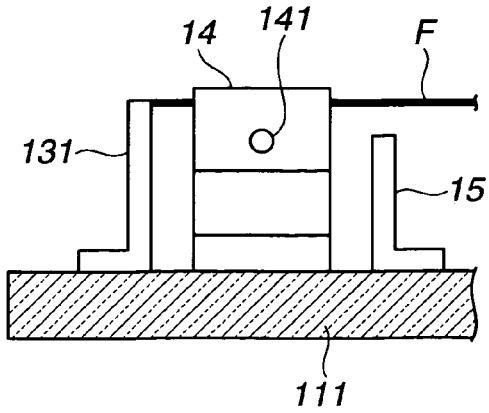

Referring to FIGS. 8(*b*) and 8(*c*), the vibration absorber 241 has two nibs 2311 and 2312. The end of the nib 2311, 2322 is bent in an L-shaped state. As shown in FIG. 8(C) (plan view), the vibration absorber 241 is engaged to the filament F such that the main portion 2416 is inserted to the holder 231 and between the nibs 2311 and 2312. The nibs 2311 and 2312 are formed in an open state. After the vibration absorber 241 is first engaged to the filament F, the nibs 2311 and 2312 are bent twice in an L-shape state, as shown in FIGS. 8(*a*) and 8(*c*).

In the case shown in FIGS. 8(*b*) and 8(*c*), since the position of the vibration absorber 241 in the longitudinal direction of the filament F can be regulated with only the holder 231, the configuration of the position regulation member is simplified. In this case, the holder 231 works as a getter shielding member and the dedicated getter shielding member can be omitted. When the nib 2311, 2312 can be formed to the getter shielding member, the getter shielding member can be used as a holder.

The nib 2314 in FIG. 8(*a*) can be combined with the nibs 2311 and 2312 in FIGS. 8(*b*) and 8(*c*).

In the embodiments mentioned above, fluorescent luminous tubes for optical print heads have been explained. However, the present invention may be applicable to electron tubes of other types including cathode filaments, such as fluorescent display tubes, flat cathode-ray tubes, and vacuum tubes. Moreover, in the above-mentioned embodiment, cathode filaments have been explained. However, the present invention may be applicable to other linear members such as linear grids, linear getters, and linear dampers for them or linear spacers for them.

What is claimed is:

1. An electron tube comprising:

an envelope;

a linear member placed in the inside of said envelope;

a support member for supporting said linear member;

a vibration absorber engaged to said linear member; and a position regulation member for regulating a moving range of said vibration absorber;

said vibration absorber being in the shape of a strip having a width in a direction of intersecting the longitudinal direction of said linear member larger than a thickness of said vibration absorber and an aperture for permitting said vibration absorber to hook said linear member so as to have said vibration absorber rested on said linear member at a position eccentric from the barycenter of said vibration absorber.

2. The electron tube of claim 1, wherein said vibration absorber is in line or point contact with a substrate of said envelope or a component in said envelope, said vibration absorber being rotatable to the line or point contact portion acting as a fulcrum.

3. The electron tube of claim 1, wherein said vibration absorber is formed of a vertical portion and wings and said position regulation member is provided with a nib for preventing said vibration absorber from disengaging said linear member.

4. The electron tube defined in claim 1, wherein said aperture of said vibration absorber is tilted with respect to a substrate of said envelope.

5. The electron tube of claim 1, wherein said bottom of said aperture lies to be shifted from the center line on a plane intersecting the longitudinal direction of said linear member and located at a position eccentric from the barycenter of said vibration absorber.

6. The electron tube of claim 1, wherein an inlet of said aperture is larger in width than a bottom of said aperture.

7. The electron tube of claim 2, wherein said vibration absorber is formed of a vertical portion and wings and said position regulation member is provided with a nib for preventing said vibration absorber from disengaging said linear member.

8. The electron tube of claim 2, wherein said bottom of said aperture lies to be shifted from the center line on a plane intersecting the longitudinal direction of said linear member and located at a position eccentric from the barycenter of said vibration absorber.

9. The electron tube of claim 2, wherein said aperture of said vibration absorber is tilted with respect to the substrate of said envelope.

10. The electron tube of claim 2, wherein said inlet of said aperture is larger in width than a bottom of said aperture.

11. The electron tube of claim 3, wherein said bottom of said aperture lies to be shifted from the center line on a plane intersecting the longitudinal direction of said linear member and located at a position eccentric from the barycenter of said vibration absorber.

12. The electron tube of claim 3, wherein said aperture of said vibration absorber is tilted with respect to the substrate of said envelope.

13. The electron tube of claim 3, wherein said inlet of said aperture is larger in width than a bottom of said aperture.

* * * * *